US005129566A

United States Patent [19]

Ogden et al.

[11] Patent Number: 5,129,566

[45] Date of Patent: Jul. 14, 1992

[54] AMPOULE HOLDERS

[75] Inventors: Brian L. Ogden, Sevenoaks; Christopher J. Griffin; Nicholas B. Verbelyi, both of London; Gerard M. O'Brien, Watford, all of United Kingdom

[73] Assignee: The Wellcome Foundation Limited, London, England

[21] Appl. No.: 643,471

[22] Filed: Jan. 18, 1991

[30] Foreign Application Priority Data

Jan. 20, 1990 [GB] United Kingdom ..... 9001378

[51] Int. Cl.[5] ..... B26B 7/92; B26F 3/00

[52] U.S. Cl. ..... 225/93; 225/103; 241/99

[58] Field of Search ..... 225/93, 103, 96.5; 241/99; 16/227, DIG. 33; 206/438, 446, 528; 215/32; 220/85 H

[56] References Cited

U.S. PATENT DOCUMENTS

| | | | |
|---|---|---|---|
| 2,638,022 | 5/1953 | Reyes | 225/93 |
| 2,659,253 | 11/1953 | Myrick | 225/93 |
| 2,865,239 | 12/1958 | McKay | 225/93 |
| 2,865,524 | 12/1958 | Reznek | 215/6 |
| 2,977,014 | 3/1961 | Kock | 215/32 X |
| 3,720,341 | 3/1973 | Greenfield et al. | 225/32 X |
| 3,738,529 | 6/1973 | Rose | 220/85 H |
| 3,933,271 | 1/1976 | McGhie | 16/227 X |
| 4,158,902 | 6/1979 | Chernack et al. | 16/227 |
| 4,793,538 | 12/1988 | Blomberg | 225/93 |

FOREIGN PATENT DOCUMENTS

| | | |
|---|---|---|
| 120524 | 12/1918 | United Kingdom . |
| 391561 | 5/1933 | United Kingdom . |
| 2081692 | 2/1982 | United Kingdom . |

*Primary Examiner*—Douglas D. Watts
*Assistant Examiner*—Clark F. Dexter
*Attorney, Agent, or Firm*—Young & Thompson

[57] ABSTRACT

An ampoule holder comprises a body part 1 and a head part 2 which are connected together by a pair of hinge strips 3 and a breakage link 4. A glass ampoule 7 is inserted, stem first, through an opening 6 in the base of the body portion 1. The body of the ampoule is forced past inwardly extending projections 8 until the lower end of the ampoule snaps past these projections and the shoulder at the top of the body of the ampoule 7 abuts against the curved hinge parts 3. The base of the ampoule will then be raised above the projections 8. The stem 10 of the ampoule is gripped within the head portion 2 of the holder by internal ribs or spines 11, so that the neck 9 of the ampoule is aligned with the breakage link 4. In order to achieve access to the contents of the ampoule the holder is gripped in two hands and pressure is applied to a finger grip surface 13 of the head portion of the holder so that the breakage link 4 is fractured and the stem 10 of the ampoule is broken off at the neck 9 whilst the head portion 2 is folded back by means of the hinge strips 3.

20 Claims, 4 Drawing Sheets

AMPOULE HOLDERS

Drugs for injecting are conventionally supplied in glass ampoules which have a body and a stem with a constriction or neck in between which is readily fractured when pressure is applied to the neck by gripping the stem and the body independently and snapping the two parts away from each other, in order to provide access to the interior of the ampoule so that the contents can be drawn into a syringe. One significant problem is that when the ampoule is being broken apart there is a risk that the user might cut his hand on the jagged exposed glass surfaces, either during the process of breaking, or after the ampoule is broken. Also the opened ampoule has to be held in one hand whilst the syringe is manipulated with the other hand, and under some circumstances it might be of advantage for the ampoule to be able to stand in a stable manner so that both hands are freed.

It is an object of this invention to alleviate the problems referred to above.

Accordingly this invention provides an ampoule holder for a glass ampoule of the type having a body, a stem and an intermediate constriction or neck intended for fracture, the holder being in the form of a sleeve having a body portion shaped to receive the ampoule body and a head portion for receipt of the stem of the ampoule, the body and head portions being joined by a hinge part allowing the two parts to be moved away from each other, such that the parts of the ampoule are protected whilst the stem and body of the ampoule are snapped away from each other.

If an ampoule is inserted into such a holder much greater protection for the user is achieved since the glass itself is not gripped whilst the stem of the ampoule is being broken off. The interlinking of the head and body portions by the hinge enables the two parts of the ampoule to be kept together after breaking of the ampoule, if the head portion is specifically designed to retain the stem. As an alternative, however the hinge could be designed so that it can readily be broken as a later step, enabling the head containing the stem to be removed totally from the body of the ampoule. It is possible for the holder to be so designed as to provide a relatively stable base enabling the ampoule in its holder to be set up on a flat surface, thus freeing the hands of the user to manipulate the syringe. The stability of the holder could be increased by providing a detachable base plate to fit the base of the body portion.

Ideally the hinge part will be disposed diametrically opposite to a breakage link. This breakage link can be in the form of a narrow reduced-thickness portion of the holder joining the body portion to the head portion. The link will break when subjected to pressure sufficient to break off the stem part of the ampoule from its body.

The hinge part will ideally comprise at least one strip of flexible material of the holder joining the head portion to the body portion. In the preferred arrangement two spaced hinge strips are provided and a portion of material may extend from either the head portion or the body portion into the region between the two hinge strips. This depending portion of material provides added protection for the user in minimizing the possibility of the user's fingers getting into contact with the glass ampoule. It is of advantage to provide that the or each hinge strip extends into a cut-away section at the end of the head portion and/or the body portion. The extension of the hinge strips in this way allows for greater movement of the head portion away from the body portion to allow good access to the interior of the ampoule through the broken neck.

In an alternative construction the hinge part can comprise a pair of flexible arms positioned generally diametrically opposite to one another. Ideally these flexible arms are interconnected between the respective top ends of the body and head portions, so that the head portion can be moved bodily away from body portion. The flexible arms are advantageously of concertina formation.

Ideally at least the hinge portion of the holder will be formed from a material having a good static memory (for example a styrene blend) so that the hinge strips will stay in the new position when the head portion is bent back to expose the opened ampoule.

In the preferred embodiment the body portion is formed with an open base for insertion of the ampoule. It is further preferred that the opening in the base should incorporate inwardly directed lugs or projections past which the lower end of the ampoule will be forced and which are to retain the ampoule. It is also advantageous for the head portion to incorporate internal ribs to grip the stem of the ampoule to ensure that the ampoule is correctly positioned within the holder so that the neck of the ampoule is aligned with or just above the hinge part (and the breakage link, when present) of the holder and so that the stem of the ampoule will not fall out when the ampoule is broken open. Preferably these ribs will extend longitudinally of the head portion and will be formed so that the inner surfaces of the ribs are generally parallel to one another along their length. This avoids the stem of the ampoule being squeezed outwardly of the head portion of the holder.

Finger grip surface portions can be provided on the outer surface of the head portion and/or the body portion. The base of the holder may advantageously incorporate a detachable base plate to increase the stability of the holder when it is set on its base.

The invention may be performed in various ways and preferred embodiments thereof will now be described with reference to the accompanying drawings, in which.

Figure 1:
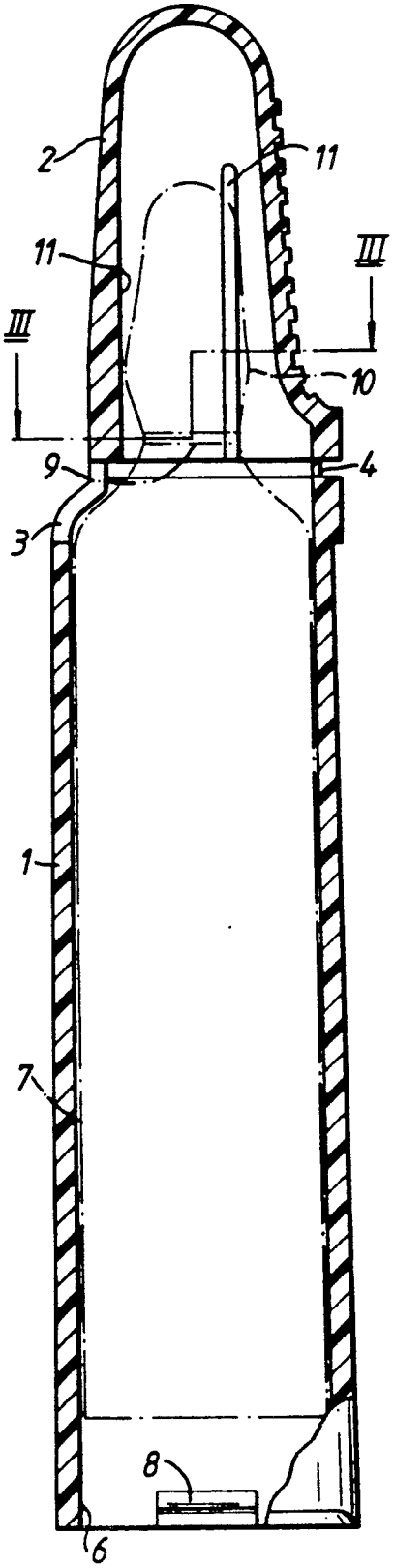
FIG. 1 is a vertical section through a preferred form of ampoule holder of this invention.
Figure 1A:
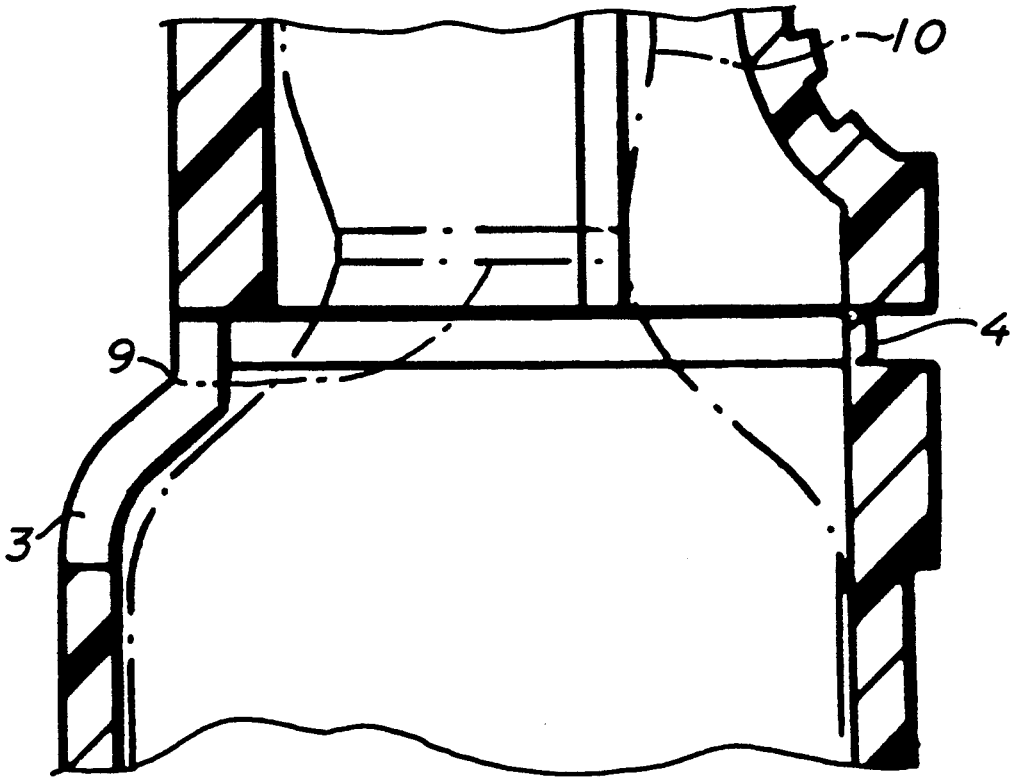
FIG. 1A is an enlarged view of part of the ampoule holder shown in FIG. 1.
Figure 2:
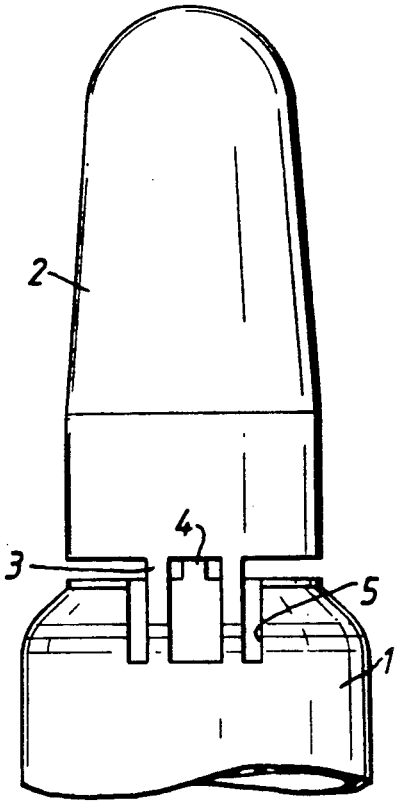
FIGS. 2 and 3 are rear and front views respectively of the top part of the holder shown in FIG. 1.
Figure 3:
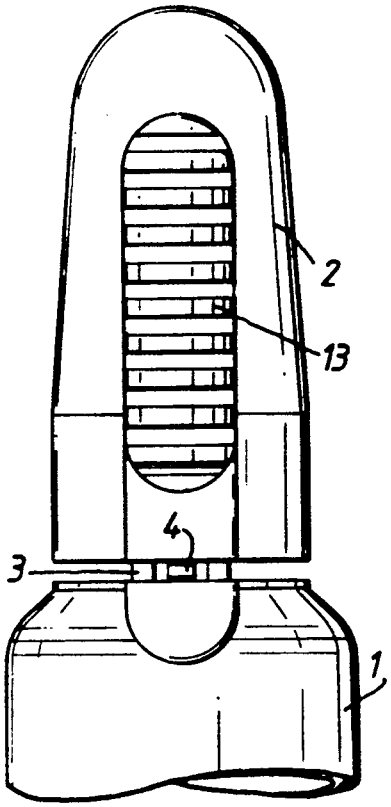
Figure 6:
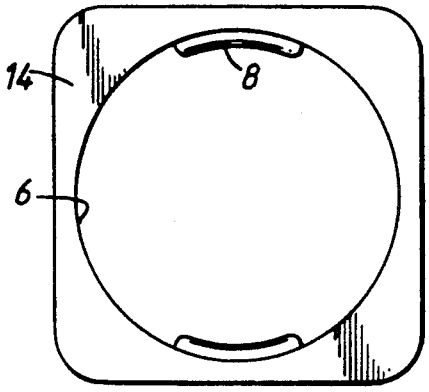
FIG. 6 is an underneath plan view of the holder of FIG. 1.

The ampoule holder shown in FIGS. 1 to 3 comprises a body part 1 and a head part 2 which are connected together by a pair of hinge strips 3 and a breakage link 4. The breakage link 4 comprises reduced thickness portion of the material from which the holder is constructed and is shaped as illustrated in FIG. 1A. The hinge strips 3 extend down into a cut-away section 5 of the body part 1. In use, a glass ampoule 7 is inserted, stem first, through an opening 6 in the base of the body portion 1 and the body of the ampoule is forced past inwardly extending projections 8 (see also FIG. 6) until the lower end of the ampoule snaps past these projections. The stem 10 of the ampoule is gripped within the head portion 2 of the holder by internal ribs or spines 11. As a result the ampoule is retained within the holder so that the neck 9 of the ampoule is aligned with or is just above the breakage link 4. Although the head portion 2 of the holder tapers inwardly towards its closed end the ribs 11 are formed so that their inner surfaces remain parallel to one another throughout their length. There is then no squeezing action tending to force the stem 10 of the ampoule out of the head portion 2 of the holder. The ampoule is pushed up until the shoulder at the top of the body of the ampoule 7 abuts against the curved hinge parts 3. The base of the ampoule will then be raised above the projections 8.

Figure 7:
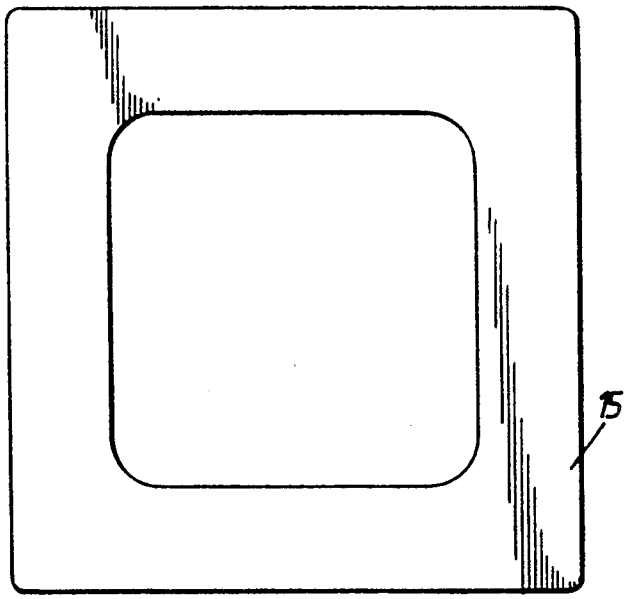
FIG. 7 is an illustration of a base plate to be used with the holder of FIG. 1.

In order to achieve access to the contents of the ampoule the holder is gripped in two hands and pressure is applied to a ridged finger grip surface 13 of the head portion of the holder so that the breakage link 4 is fractured at one of the reduced thickness portions illustrated in FIG. 1A and the stem 10 of the ampoule is broken off at the neck 9 whilst the head portion 2 is folded back by means of the hinge strips 3. These hinge strips (and indeed the rest of the ampoule holder) are formed from a styrene blend material which has a good static memory so that when the hinge is bent into a new position it will hold the head portion 2 away from the open neck of the ampoule 7, thus providing clear access to the contents of the ampoule. After fracture the body portion of the ampoule 7 will drop down onto the projections 8, so that the rough broken glass edge will drop below the top of the body part 1, for added protection of the user. The ampoule holder can be set on a flat surface by means of its flat base 14. For added stability a detachable base plate 15 (FIG. 7) could be provided, into which the base of the ampoule holder will be fitted.

Figure 4:
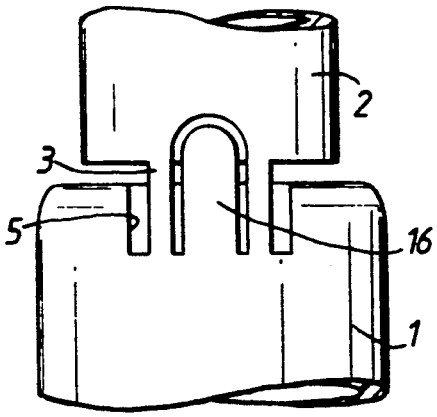
FIG. 4 is a detail of a modification of the parts illustrated in FIG. 2.
Figure 5:
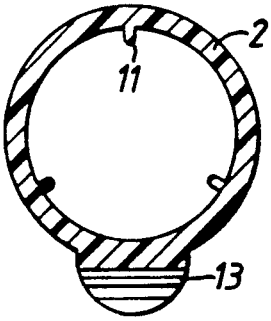
FIG. 5 is a section on line III—III of FIG. 1.

As shown in FIG. 4 the hinge area of the ampoule holder could be modified to incorporate a "paddle" 16 between the hinge strips 3. This enables the hinge strips to be spaced well apart whilst protecting the user still further from the broken glass portions of the ampoule 7.

Figure 8:
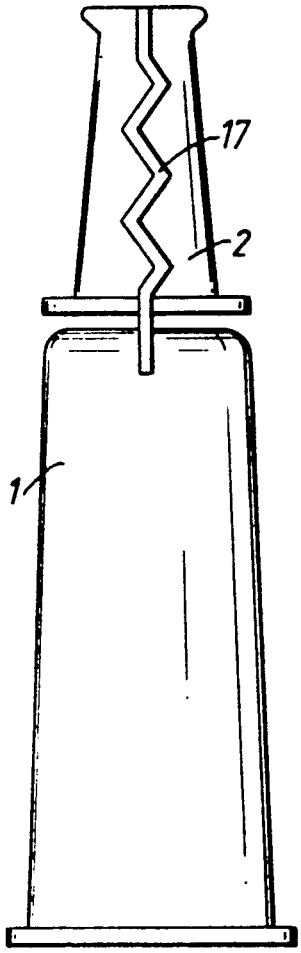
FIG. 8 illustrates a further embodiment of an ampoule holder of the invention.

The modified form of ampoule holder shown in FIG. 8 has the head part 2 connected to the body part 1 by means of a pair of flexible arms 17 of the concertina shape as shown in FIG. 8. These arms 17 are connected to the respective top ends of the body part 1 and the head part 2. The arms 17 will normally hold the head and body parts in general alignment, but pressure may be applied between the head and body parts to cause the neck of an ampoule within the holder to be fractured. The head part, enclosing the stem of the ampoule, can then be moved to one side by means of the flexible arms 17 to provide access to the interior of the body of the ampoule.

We claim:

1. An ampoule holder for a glass ampoule of the type having a body, a stem and an intermediate constriction or neck intended for fracture, the holder being in the form of a sleeve having a base, a body portion shaped to receive the ampoule body, and a head portion for receipt of the stem of the ampoule, the base defining an opening for the insertion of the ampoule, a flexible hinge part joining the body and head portions and allowing said body and head portions to be moved away from each other, a breakage link integrally connecting the body and head portions at a position diametrically opposite to the hinge part, the body and head portions of the holder being held by the hinge part and breakage link in a stable aligned condition until such time as the breakage link is broken as the head portion is levered away from the body portion in order to snap the neck of the ampoule, whereafter the head portion is bent away about the hinge part to provide access to the body of the ampoule, the parts of the ampoule being protected by the body and head portions of the holder whilst the stem and body of the ampoule are snapped away from each other.

2. An ampoule holder according to claim 1, wherein the breakage link is a narrow reduced-thickness portion of the holder joining the body portion to the head portion.

3. An ampoule holder according to claim 1, wherein the hinge part comprises at least one strip of flexible material of the holder joining the head portion to the body portion.

4. An ampoule holder according to claim 3, wherein two spaced hinge strips are provided and a portion of material extends from the body portion into the region between the two hinge strips.

5. An ampoule holder according to claim 3, wherein each hinge strip extends into a cut-away section at an end of the body portion.

6. An ampoule holder according to claim 1, wherein at least the hinge portion is formed from a material having a good static memory.

7. An ampoule holder according to claim 1, wherein the opening in the base incorporates inwardly directed lugs or projections past which the lower end of the ampoule will be forced and which act to retain the ampoule.

8. An ampoule holder according to claim 1, wherein the head portion incorporates internal ribs to grip the stem of the ampoule.

9. An ampoule holder according to claim 8, wherein the ribs extend longitudinally of the head portion and are formed so that the inner surfaces of the ribs are generally parallel to one another along their length.

10. An ampoule holder according to claim 1, wherein a ridged finger grip surface portion is provided on the outer surface of the head portion.

11. An ampoule holder according to claim 1, wherein the base of the holder incorporates a detachable base plate to increase the stability of the holder when it is set on its base.

12. An ampoule holder for a glass ampoule of the type having a body, a stem and an intermediate constriction or neck intended for fracture, the holder being in the form of a sleeve having a base, a body portion shaped to receive the ampoule body and a head portion for receipt of the stem of the ampoule, the base defining an opening for the insertion of the ampoule, a hinge part joining the body and head portions and comprising a pair of flexible arms positioned generally diametrically opposite one another and normally retaining the body and head portions in an aligned condition, whereby the parts of the ampoule are protected by the body and head portions of the holder, whilst allowing said body and head portions to be moved away from each other, to enable the stem and body of the ampoule to be snapped away from each other, whereafter displacement of the head portion with the ampoule stem away from the body portion provides access to the open body of the ampoule.

13. An ampoule holder according to claim 12, wherein the flexible arms are interconnected between the respective top ends of the body and head portions.

14. An ampoule holder according to claim 12, wherein the flexible arms are of concertina formation.

15. An ampoule holder according to claim 12, wherein at least the hinge portion is formed from a material having a good static memory.

16. An ampoule holder according to claim 12, wherein the opening in the base incorporates inwardly directed lugs or projections past which the lower end of the ampoule will be forced and which act to retain the ampoule.

17. An ampoule holder according to claim 12, wherein the head portion incorporates internal ribs to grip the stem of the ampoule.

18. An ampoule holder according to claim 17, wherein the ribs extend longitudinally of the head portion and are so formed that the inner surface of the ribs are generally parallel to one another along their length.

19. An ampoule holder according to claim 12, wherein a ridged finger grip surface portion is provided on the outer surface of the head portion.

20. An ampoule holder according to claim 12, wherein the base of the holder incorporates a detachable base plate to increase the stability of the holder when it is set on its base.

* * * * *